US010906077B2

(12) United States Patent
Muschalik et al.

(10) Patent No.: US 10,906,077 B2
(45) Date of Patent: Feb. 2, 2021

(54) DIRECT OR INDIRECT METAL PIPE EXTRUSION PROCESS, MANDREL FOR EXTRUDING METAL PIPES, METAL PIPE EXTRUDER AND EXTRUDED METAL PIPE

(71) Applicant: SMS group GmbH, Duesseldorf (DE)

(72) Inventors: Uwe Muschalik, Duisburg (DE); Jens Magenheimer, Aachen (DE); Anna Rott, Aachen (DE); Koos van Putten, Heerlen (NL)

(73) Assignee: SMS group GmbH, Duesseldorf (DE)

( * ) Notice: Subject to any disclaimer, the term of this patent is extended or adjusted under 35 U.S.C. 154(b) by 465 days.

(21) Appl. No.: 15/638,535

(22) Filed: Jun. 30, 2017

(65) Prior Publication Data

US 2017/0297069 A1 Oct. 19, 2017

Related U.S. Application Data

(62) Division of application No. 14/416,728, filed as application No. PCT/DE2013/000401 on Jul. 24, 2013, now abandoned.

(30) Foreign Application Priority Data

Jul. 27, 2012 (DE) ..... 10 2012 014 836
Nov. 8, 2012 (DE) ..... 10 2012 021 787

(51) Int. Cl.
*B21C 25/04* (2006.01)
*B21C 23/08* (2006.01)
(Continued)

(52) U.S. Cl.
CPC ..... *B21C 25/04* (2013.01); *B21C 23/085* (2013.01); *B21C 23/205* (2013.01); *B21C 23/217* (2013.01); *B21C 25/08* (2013.01)

(58) Field of Classification Search
CPC ..... B21C 25/08; B21C 23/085; B21C 23/217; B21C 23/205; B21C 23/218; B21C 25/04
See application file for complete search history.

(56) References Cited

U.S. PATENT DOCUMENTS 3,362,208 A * 1/1968 Murphy ..... B21C 23/21 72/260
3,820,374 A * 6/1974 Braeuninger ..... B21C 25/04 72/265
(Continued)

FOREIGN PATENT DOCUMENTS

DE 100 21 881 A1 11/2001
JP S52138045 U 10/1977
(Continued)

OTHER PUBLICATIONS

German Office Action in DE 10 2012 021 787.0, dated Sep. 18, 2016 with English translation of relevant parts.
(Continued)

*Primary Examiner* — Gregory D Swiatocha
(74) *Attorney, Agent, or Firm* — Collard & Roe, P.C.

(57) ABSTRACT

If a mandrel for extruding metal pipes, having two axially offset pressing surfaces with different radial characteristics and having a transition region between these two pressing surfaces has a support surface in the transition region then the negative effect of narrowing, which arises owing to the mandrel shifting from a first pressing position, in which the first of the two pressing surfaces interacts with a die, to a second pressing position, in which the second pressing surface interacts with the die, can be minimized.

6 Claims, 6 Drawing Sheets

(51) Int. Cl.

| | |
|---|---|
| ***B21C 23/21*** | (2006.01) |
| ***B21C 25/08*** | (2006.01) |
| ***B21C 23/20*** | (2006.01) |

(56) References Cited

U.S. PATENT DOCUMENTS

| | | | | |
|---|---|---|---|---|
| 3,826,122 | A * | 7/1974 | Braeuninger | B21C 25/04 72/264 |
| 3,868,841 | A * | 3/1975 | Couchman | B21C 23/217 72/260 |
| RE28,600 | E | 11/1975 | Lemelson | |
| 3,950,979 | A | 4/1976 | Fuchs, Jr. | |
| 4,230,661 | A | 10/1980 | Asari et al. | |
| 4,292,831 | A * | 10/1981 | Simon | B21C 23/14 72/260 |
| 4,301,672 | A * | 11/1981 | Simon | B21C 25/08 72/260 |
| 5,522,246 | A * | 6/1996 | Simon | B21C 25/08 72/260 |
| 6,155,092 | A * | 12/2000 | Sahlem | B21C 23/085 72/260 |
| 6,470,726 | B1 | 10/2002 | Murata et al. | |
| 7,578,161 | B1 * | 8/2009 | Sizemore | B21D 41/021 29/890.043 |
| 7,644,601 | B2 * | 1/2010 | Brochheuser | B21C 1/24 72/283 |
| 2007/0137277 | A1 * | 6/2007 | Tye | B21C 23/085 72/260 |
| 2010/0011833 | A1 * | 1/2010 | Sizemore | B21D 41/021 72/370.06 |

FOREIGN PATENT DOCUMENTS

| | | | |
|---|---|---|---|
| JP | S 52-138045 | A | 11/1977 |
| JP | H01-192414 | A | 8/1989 |
| JP | H06106233 | A | 4/1994 |
| JP | H06304644 | A | 11/1994 |
| JP | H 11-347624 | A | 12/1999 |
| JP | H11347264 | A | 12/1999 |
| RU | 2 352 417 | C2 | 4/2009 |
| SU | 507380 | A1 | 3/1976 |

OTHER PUBLICATIONS

Japanese Office Action (Notification of Reason for Refusal) in JP 2015-523419, dated Mar. 1, 2016.

English translation of Russian Office Action in RU 2015101559/02(002304), dated Aug. 5, 2016.

English translation of a Chinese Office Action dated Aug. 3, 2015 in Chinese Application No. 201380039526.4.

International Search Report of PCT/DE2013/000401, dated Nov. 28, 2013.

* cited by examiner

DIRECT OR INDIRECT METAL PIPE EXTRUSION PROCESS, MANDREL FOR EXTRUDING METAL PIPES, METAL PIPE EXTRUDER AND EXTRUDED METAL PIPE

CROSS REFERENCE TO RELATED APPLICATIONS

This application is divisional of and Applicant claims priority under 35 U.S.C. §§ 120 and 121 of U.S. patent application Ser. No. 14/416,728 filed on Jan. 23, 2015, which application is the National Stage of PCT/DE2013/000401 filed on Jul. 24, 2013, which claims priority under 35 U.S.C. § 119 of German Application Nos. 10 2012 014 836.4 filed on Jul. 27, 2012 and 10 2012 021 787.0 filed on Nov. 8, 2012, the disclosures of which are incorporated by reference. The international application under PCT article 21(2) was not published in English.

BACKGROUND OF THE INVENTION

1. Field of the Invention

The invention relates to a direct or indirect metal pipe extrusion method, in which a metal block is pressed to form a metal pipe, through a die and by way of a mandrel, wherein the mandrel has two pressing surfaces disposed to be axially offset and having different radial characteristics, and is optionally positioned in two pressing positions, axially with reference to the die, in such a manner that in a first one of the two pressing positions, a first one of the two pressing surfaces acts on the work piece pressed from a metal block into a metal pipe, forming it, and in a second of the two pressing positions, a second of the two pressing surfaces acts on it. Also, the invention relates to a mandrel for pressing metal pipes, having two pressing surfaces disposed to be axially offset and having different radial characteristics, and having a transition region between the two pressing surfaces. Likewise, the invention relates to a metal pipe extruder having a block mount, having a die and having a mandrel. Furthermore, the invention relates to an extruded metal pipe, preferably composed of aluminum, having two different wall thicknesses and a transition region situated between the wall thicknesses, wherein a constriction is present in the transition region.

2. Description of the Related Art

Such direct or indirect metal pipe extrusion methods are sufficiently known from the state of the art, whereby the inside diameter of the metal pipes pressed in this manner can be changed accordingly, complementary to the pressing surfaces, in each instance, by means of a mandrel having two pressing surfaces disposed to be axially offset and having different radial characteristics, which mandrel is optionally displaced axially; the pressing surfaces, as active surfaces, form a related gap in interplay with the die, which gap can accordingly also be changed, and through which gap the work piece is pressed, shaping it. By means of axial displacement of the mandrel, in such a manner that optionally, the first of the two pressing surfaces or the second of the two pressing surfaces interacts accordingly with the die, this can be changed accordingly, in targeted manner. While naturally the change in wall thickness takes place by means of a change in the inside diameter in the case of such a configuration of a metal pipe extruder or in the case of such method management, such extruded metal pipes have a constriction radially on the outside in their transition region between the two wall thicknesses.

Such metal pipes having different wall thicknesses are known, for example, as drill piping, but can be used for other purposes, for example as a housing. In this connection, aluminum pipes or pipes composed of aluminum or of similar metals that can be extruded accordingly are particularly important in this regard.

SUMMARY OF THE INVENTION

It is the task of the present invention to make available a direct or indirect metal pipe extrusion method, a mandrel for pressing metal pipes, a metal pipe extruder, as well as an extruded metal pipe, in which the negative influences of the constrictions are minimized.

As a solution, a direct or indirect metal pipe extrusion method having the characteristics according to one aspect of the invention, a mandrel for pressing metal pipes having the characteristics according to another aspect of the invention, a metal pipe extruder having the characteristics according to another aspect of the invention, as well as an extruded metal pipe having the characteristics according to another aspect of the invention are proposed.

Further advantageous embodiments are discussed below.

In this connection, a direct or indirect metal pipe extrusion method in which a metal block is pressed to form a metal pipe, through a die and by way of a mandrel, and in which the mandrel has two pressing surfaces disposed to be axially offset and having different radial characteristics, and is optionally positioned in two pressing positions, axially with reference to the die, in such a manner that in a first one of the two pressing positions, a first one of the two pressing surfaces acts on the work piece pressed from a metal block into a metal pipe, forming it, and in a second of the two pressing positions, a second of the pressing surfaces acts on it, can be characterized in that the work piece is supported, on the mandrel side, at the axial height of the die, while the mandrel is positioned, with regard to the die, from the first pressing position to the second position.

By means of such supporting on the mandrel side, it is possible to particularly change the depth, but also the length of such a constriction. Thus, for example, the depth of the constriction can be reduced, so that the effects of the constriction are reduced accordingly. Likewise, for example, the length of the constriction can be increased by means of support, so that possible guidance inaccuracies on the outside of the metal pipe or the occurrence of peak loads within the metal pipe can be reduced accordingly.

Accordingly, an extruded metal pipe having two different wall thicknesses and a transition region situated between the wall thicknesses, wherein a constriction is present in the transition region, can be characterized in that the constriction has a depth that is less than the difference of the two wall thicknesses. Preferably, the deviation of this difference amounts to at least 10%. However, it can also amount to 15% or more, if suitable method management is present. By means of the support provided in the method management, it is possible, for the first time, to reduce the depth of the constriction in targeted manner.

Likewise, it is possible, for the first time, by means of the support, to make available an extruded metal pipe having two different wall thicknesses and a transition region situated between the wall thicknesses, in which a constriction is present in the transition region, and which is characterized in that the constriction has a length that is greater than the difference of the two wall thicknesses, whereby here, too, the deviation from the difference of the two wall thicknesses can amount to at least 10%. Depending on the concrete method management, however, the deviation from the difference can amount to as much as 100%. Likewise, in the case of suitable method management, the length of the constriction can actually be selected to be longer than the smaller or even longer than the greater wall thickness. In this connection, however, it must be taken into consideration that an overly long transition region between the two wall thicknesses ultimately leads to the result that correspondingly increased material consumption is recorded during production of the metal pipe, which accordingly can also lead to undesired results, so that naturally, an upper limit must be found here.

Complementary to a variation in the constriction, a variation in the wall thickness in the region of this constriction takes place. Accordingly, it is possible for the first time, by means of this method management, to influence the wall thickness in the region of the constriction in targeted manner. In this regard, an extruded metal pipe having two different wall thicknesses and a transition region situated between the wall thicknesses, in which a constriction is present in the transition region, can be characterized in that the wall thickness is greater than the smaller of the two wall thicknesses in the region of the constriction. The latter can particularly be configured, in the case of suitable method management, to the effect that in the region of the constriction, the wall thickness is greater than the smaller of the two wall thicknesses by at least 10% of the difference of the two wall thicknesses, preferably by 20% of the difference of the two wall thicknesses.

In a concrete implementation of the method management explained above, supporting the work piece at the axial height of the die can take place only after the work piece has formed a free surface with regard to the mandrel. Such a free surface occurs when the mandrel is axially offset and thereby positioned from the first pressing position to the second pressing position, although the work piece or the metal block continues to be put under pressure. This is due to the fact that the work piece is plasticized for shaping it and pressed between die and mandrel. Although the work piece is therefore formable and can adapt to a changed volume that is offered between mandrel and die, such adaptation does not take place immediately, because of the great viscosity of the plasticized material, and therefore also not at the speed at which the mandrel is displaced. In this regard, some time elapses until the work piece, with its plasticized regions, once again fills the space released by the positioning of the mandrel from the first pressing position to the second pressing position. Because support only takes place after the work piece has formed a free surface with regard to the mandrel, the work piece can at first start a flowing process into this free space, before support takes place, thereby making it possible to continue to initiate the required material displacement as quickly as possible, and to keep the transition region between the different wall thicknesses to a minimum.

Preferably, support only takes place once the free surface is displaced in the direction of the mandrel. In the case of such method management, corresponding plastic displacement far into the metal block can take place, so that the free space created by repositioning the mandrel is filled with material again as quickly as possible. Accordingly, the transition region between the two wall thicknesses of the metal pipe is kept to a minimum.

A mandrel for pressing metal pipes having two pressing surfaces disposed to be axially offset and having different radial characteristics, as well as having a transition region between the two pressing regions, can be characterized in that the mandrel has a supporting surface in the transition region.

As already explained initially, in this connection the term "pressing surfaces" refers to the surfaces that define the gap between mandrel and die during pressing, in interaction with the die, and acts on the work piece to form it. Other surfaces of the mandrel do not come into contact with the material at all, or have no noteworthy influence on the forming process, because the material simply flows past the corresponding surfaces.

By means of the supporting surface in the transition region, it is possible to implement support of the work piece on the mandrel side, in simple manner, at the axial height of the die, while the mandrel is moved from the first pressing position to the second pressing position, with regard to the die.

Preferably, the supporting surface has a constant cross-section over an axial supporting length, so that defined support is offered to the material, when it flows into the free space between die and mandrel. In this connection, it should be emphasized that generally, such pressed metal pipes have a round cross-section, so that a mandrel is, accordingly, also shaped to be essentially cylindrical. This holds true, accordingly, also for the pressing surfaces, as well as preferably for the supporting surface. On the other hand, such a round cross-section is not absolutely necessary, whereby, however, in an axial length expanse region of the mandrel, the pressing surfaces are oriented parallel to the mandrel axis, so that planes laid through the mandrel axis, which are inclined, in the manner of cylinder coordinates, about angles that lie perpendicular to the mandrel axis, the pressing surfaces are generally oriented parallel to the mandrel axis, and radial changes take place only perpendicular to the mandrel axis.

Because an overly great supporting length might lead to disadvantageous flow behavior, when the mandrel is positioned in final manner, it can be advantageous if the supporting length is less than or equal to 80% of the axial distance between the two pressing surfaces. In particular, it can be selected to be less than 60% or 50% of the axial distance between the two pressing surfaces. If necessary, it is even possible, particularly if multiple supporting surfaces having different cross-sections are used, to select the supporting length of the individual supporting surfaces to be even smaller. Furthermore, it has been shown that the supporting length should preferably be greater than or equal to 2% of the axial distance between the two pressing surfaces. Preferably, the supporting length is greater than or equal to 5% or 10% of the axial distance between the two pressing surfaces. In this manner, sufficient support can be ensured.

In general, the mandrel will monotonously narrow in each cross-section that runs through the mandrel axis, from the mandrel foot to the mandrel tip, which means—aside from possible holding apparatuses in the region of the mandrel foot—it will have no widening in radius. This appears to be practical if only for energy reasons. In this regard, it is accordingly advantageous if the first of the two pressing surfaces is disposed to be farther removed from the mandrel tip, with a greater distance from the mandrel axis, than the second of the two pressing surfaces.

The different radial characteristics of the two pressing surfaces result, at least in a specific angle about the mandrel axis, corresponding to a section through the mandrel axis, which section is laid precisely at this angle, in a difference of the corresponding radii of these two pressing surfaces relative to the mandrel axis, because otherwise, naturally no different radial characteristics would be present. Preferably, the radius of the supporting surface, which is oriented at the same angle about the mandrel axis, is smaller than the larger of the two radii by more than 5% of the radius difference, or than a radius of a further supporting surface oriented at the same angle about the mandrel axis. In this manner, a sufficiently large space can be created, in operationally reliable manner, which space is sufficient for breaking out the material of the work piece. In particular, it can be ensured, in this manner, that the space is not compensated merely by elastic expansion of the work piece into this region. Preferably, the radius of the supporting surface oriented at the same angle about the mandrel axis is smaller, by less than 70% of the radius difference, than the greater of the two radii or than the radius of a further supporting surface oriented at the same angle about the mandrel axis. In this manner, it can be ensured that the supporting surface is not too far away from the free material surface and an overly great material flow into this free space occurs, which is not supported quickly enough. In preferred embodiments, the supporting surface can be smaller by more than 7% or more than 10% of the radius difference. Likewise, the radius of the supporting surface can be configured to be smaller by less than 55% or 50% of the radius difference.

If necessary, several supporting surfaces can be provided, which also leads—depending on the concrete method management—to an extruded metal pipe having two different wall thicknesses and a transition region situated between the wall thicknesses, in which a constriction is present in the transition region, and which is characterized by at least two constrictions. Such a configuration having two constrictions can be implemented, under some circumstances, with only one supporting surface, if the mandrel is not positioned from the first pressing position to the second pressing position in a single step, but rather if this repositioning takes place in multiple steps. If necessary, the supporting surface can also be configured to be conical for this purpose, or can narrow at an angle about the mandrel axis. In the case of multiple supporting surfaces, as well, an influence on the configuration and the number of constrictions can be exerted in targeted manner by means of step-by-step repositioning.

By means of the at least two constrictions, it can be implemented, in the case of suitable implementation of the present invention, that the constriction is smaller, in each instance, in other words minimized in terms of its effect, and this cumulatively leads to a corresponding reduction in the disadvantageous effects.

The present invention is particularly suitable for aluminum or aluminum pipes, and for other extrudable metals or metal pipes. In particular, the present invention is suitable for drill piping composed of such materials, for example, or also for corresponding tubular structures for other purposes, composed of such materials.

It is understood that the characteristics of the solutions described above and in the claims can also be combined, if necessary, in order to be able to implement the advantages cumulatively, accordingly.

BRIEF DESCRIPTION OF THE DRAWINGS

Further advantages, goals, and properties of the present invention will be explained using the following description of exemplary embodiments, which are also particularly shown in the attached drawing. The drawing shows.

DETAILED DESCRIPTION OF PREFERRED EMBODIMENTS

Figure 1:
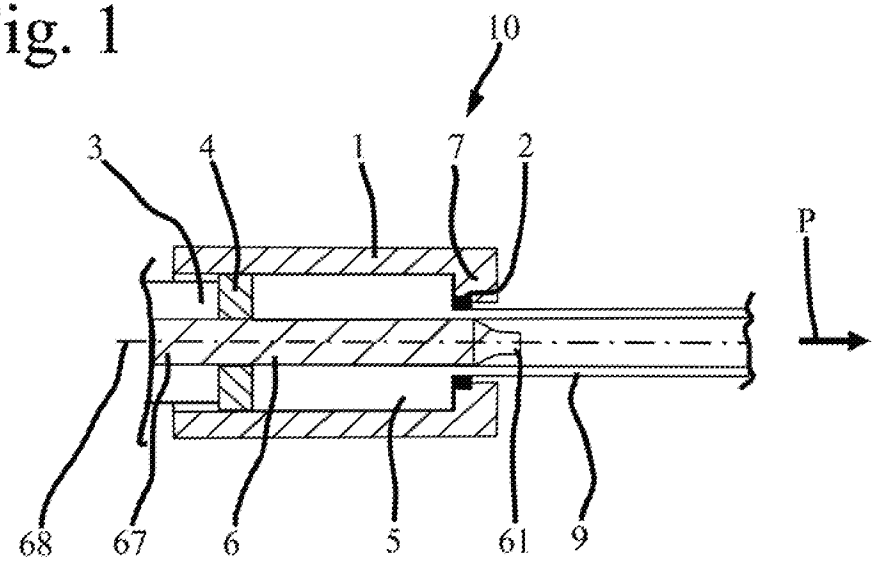
FIG. 1 a schematic overview of a direct metal pipe extruder having a mandrel situated in the first pressing position.

The two metal pipe extruders 10 and 20 each have a block mount 1, a die 2, a pressing punch 3 that can be displaced relative to the block mount 1, as well as a mandrel 6 that forms a gap, together with the die 2, through which a work piece is pressed from a metal block 5 into a metal pipe 9. This takes place, in each instance, in that the block mount 1 is displaced relative to the pressing punch 3, thereby causing the space in the block mount 1 to be reduced accordingly, and a metal block 5 situated there to be pressed through the gap between die 2 and mandrel 6, in each instance.

Figure 2:
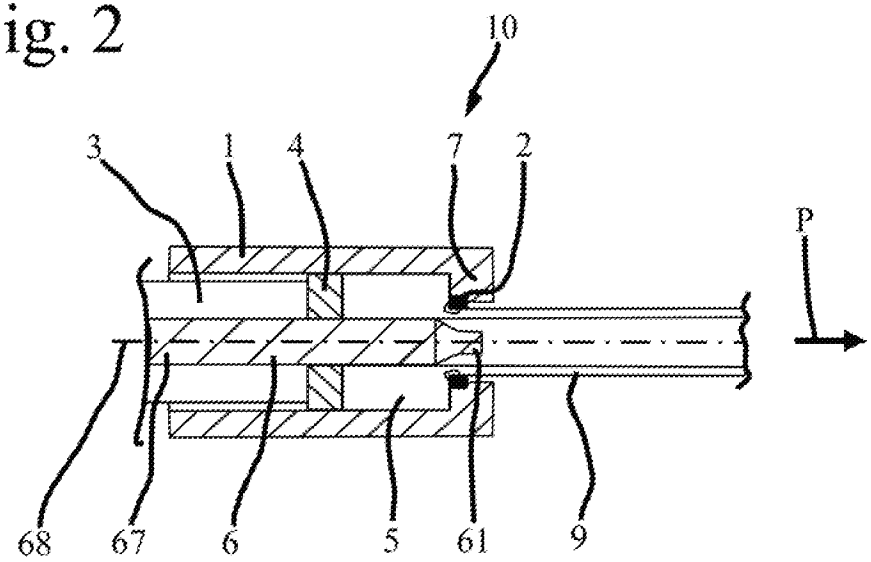
FIG. 2 the arrangement according to FIG. 1, wherein the mandrel is being positioned in the second pressing position.
Figure 3:
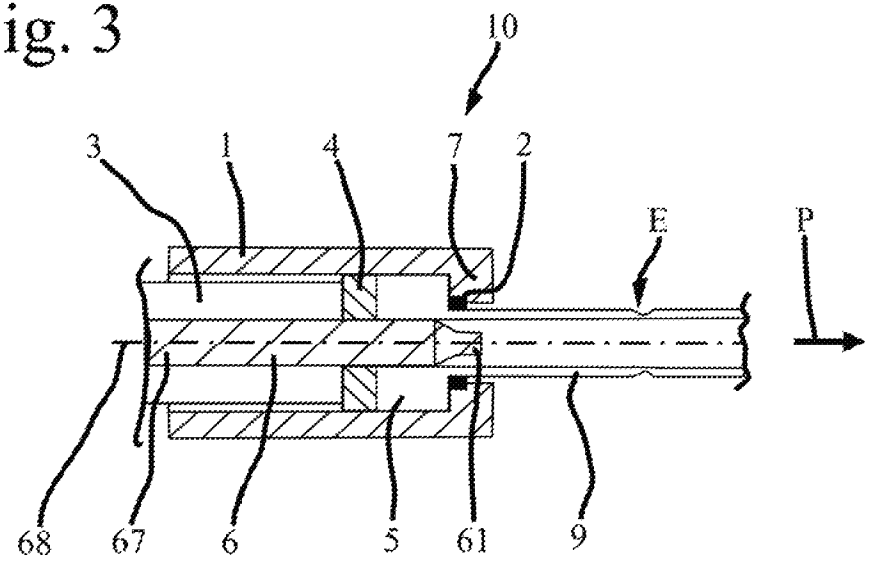
FIG. 3 the arrangement according to FIGS. 1 and 2, with the mandrel situated in the second pressing position.

For this purpose, the direct metal pipe extruder 10 shown in FIGS. 1 to 3 has a pressing punch 3 disposed ahead of the block mount 1 in the pressing direction P, which punch drives a pressing disk 4 into the block mount 1 in the pressing direction P, in known manner, thereby causing the space present in the block mount 1 to be reduced accordingly. In this connection, a die holder 7 is provided on the block mount 1, on which holder the die 2 is held in locally fixed manner, with reference to the block mount 1. If the pressing punch 3 is now moved in the pressing direction P, the work piece is pressed through the gap to form a metal pipe 9, which leaves the gap in the pressing direction P.

Figure 4:
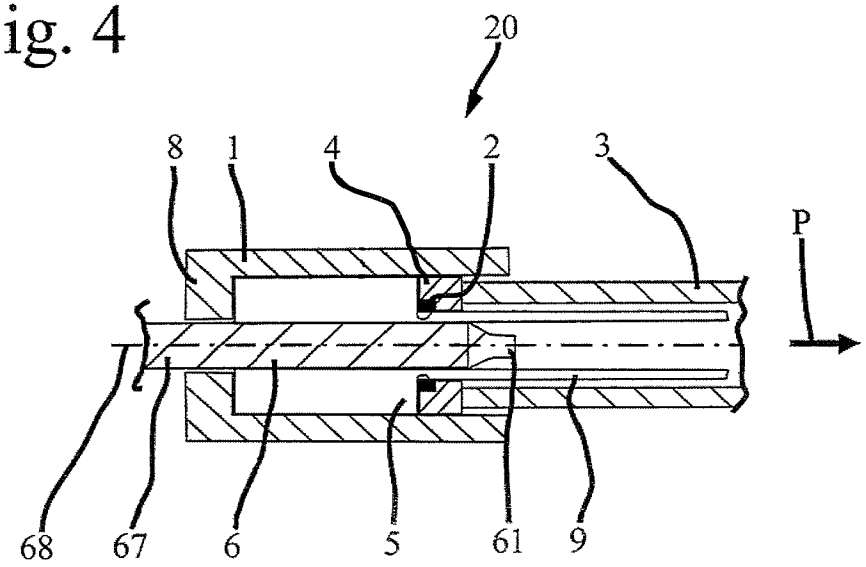
FIG. 4 an indirect metal pipe extruder in representations similar to FIGS. 1 to 3, with the mandrel in the first pressing position.

The indirect metal pipe extruder 20 shown in FIG. 4 comprises a pressing punch 3 disposed behind the block mount 1 in the pressing direction P, which punch is moved counter to the pressing direction P for pressing and carries the die 2, wherein the block mount 1 has a closure piece 8 on its end facing away from the pressing punch 3, which closes off this mount counter to the pressing direction P. If the pressing punch 3 is now displaced counter to the pressing direction P, this punch presses the die 2 in the direction toward the closure piece 8, by way of the mandrel 6, so that the die 2 is displaced with reference to the block mount 1, in other words, does not remain fixed in place with reference to the block mount 1, in contrast to the case of direct metal pipe extruder 10. In this exemplary embodiment, the mandrel 6 is displaced with reference to the block mount 1, together with the pressing punch 3 or the die 2.

It is understood that the relative movement between pressing punch 3 and block mount 1 can be implemented in different ways, for example in that the block mount 1 is held still and the pressing punch 3 is moved, or on the other hand, the pressing punch 3 is held still and the block mount 1 is moved. Likewise, it is possible to move both modules, as long as the relative movement between pressing punch 3 and block mount 1 required for pressing remains implemented.

In the present exemplary embodiments, the mandrel is configured to have rotation symmetry with regard to its mandrel axis 68, but this is not absolutely necessary in all embodiments.

Figure 5:
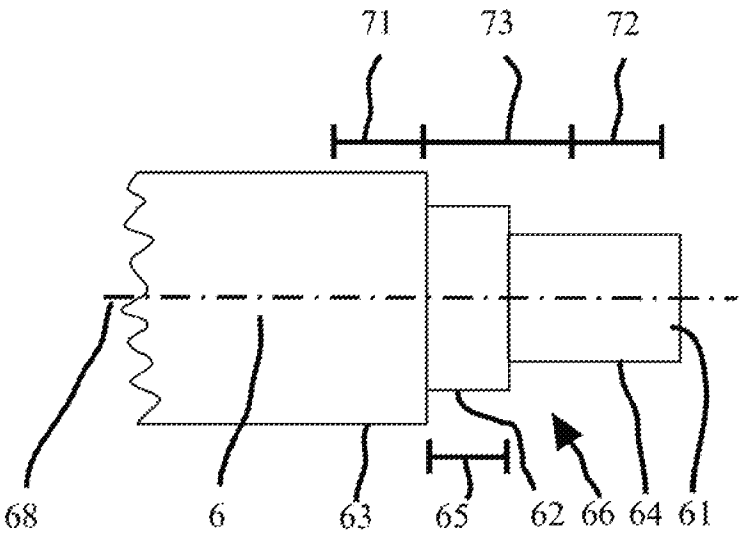
FIG. 5 a detail view of the mandrel tip of the mandrel according to FIGS. 1 to 4.

As FIG. 5 particularly shows, the mandrel 6 narrows toward its mandrel tip 61 and has a first pressing surface 63 and a second pressing surface 64, which can be brought into a position in each instance in which they directly act on the material of the work piece, together with the die 2, forming it, and are able to shape the metal pipe 9 by axial displacement of the mandrel 6.

Figure 6:
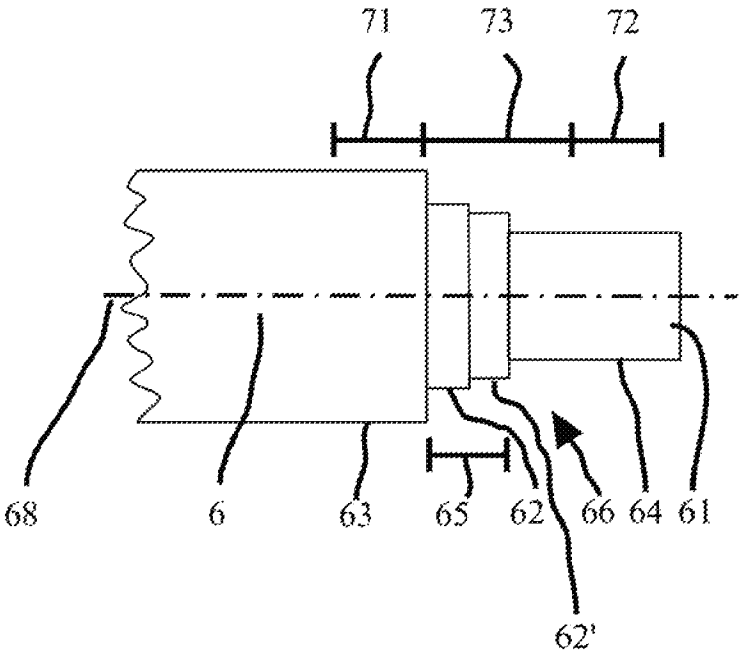
FIG. 6 a detail view of the mandrel tip similar to FIG. 5 showing two supporting surfaces.

A transition region 66 is disposed between the first pressing surface 63 and the second pressing surface 64, in which region is provided a supporting surface 62 (FIG. 5), or a supporting surface 62 and a further supporting surface 62' (FIG. 6), each of which is oriented cylindrically around the mandrel axis 68 in each of these exemplary embodiments. The support length 65 of supporting surface 62 in the embodiment shown in FIG. 5 is equal to the support length 65 of supporting surface 62 and the further supporting surface 62' in the embodiment shown in FIG. 6.

In the axial direction, the first pressing surface 63 has a length 71 and the second pressing surface 64 has a length 72. A distance 73 can be found between the two pressing surfaces 63, 64, which distance defines the transition region 66.

The mandrel rod 6 is held in place in known manner, at its mandrel foot 67, and can be displaced by way of the latter. In particular, it can be positioned from a first pressing position, in which the first pressing surface 63 interacts with the die 2, into a second pressing position, in which the second pressing surface 64 interacts with the die 2, as has been shown as an example in FIGS. 1 to 3.

By means of this repositioning, the wall thickness can be changed in accordance with the different cross-sections of the two pressing surfaces 63, 64, whereby in the end result, a metal pipe 9 having different wall thicknesses and a transition region provided between them can be made available. In this connection, there is a constriction E in the transition region, which can be minimized by means of suitable support during repositioning of the mandrel, and can even be avoided entirely, if applicable.

The present exemplary embodiments relate to aluminum pipes as the metal pipe 9, whereby other metals that can be pressed to form pipes, by means of extrusion methods, can also be used alternatively, accordingly, if applicable.

REFERENCE SYMBOL LIST

1 block mount
2 die
3 pressing punch
4 pressing disk
5 metal block
6 mandrel
7 die holder
8 closure piece
9 metal pipe
10 direct metal pipe extruder
20 indirect metal pipe extruder
61 mandrel tip
62 supporting surface
62' further supporting surface
63 first pressing surface
64 second pressing surface
65 support length
66 transition region
67 mandrel foot
68 mandrel axis
71 length of the first pressing surface
72 length of the second pressing surface
73 distance between the pressing surfaces
E constriction
P pressing direction

What is claimed is:

1. A method for extrusion of a metal pipe comprising the following steps:

(a) providing a mandrel having a first end and a second end disposed opposite from each other, the mandrel having two pressing surfaces disposed at the first end and axially offset and having different radial characteristics, wherein the mandrel has a transition region between the two pressing surfaces and a supporting surface in the transition region;

(b) pressing a metal block to form the metal pipe, through a die and by way of the mandrel;

(c) moving the mandrel axially in a direction of the second end of the mandrel from a first pressing position to a second pressing position, in the first pressing position, a first one of the two pressing surfaces of the mandrel acts on the metal block, and in the second pressing position, a second of the two pressing surfaces of the mandrel acts on the metal block; and (d) supporting the metal block on a mandrel side of the metal block, at an axial height of the die, while the mandrel is moved from the first pressing position to the second position.

2. The metal pipe extrusion method according to claim 1, wherein the supporting takes place first after a free surface with regard to the mandrel is formed on the metal block.

3. The metal pipe extrusion method according to claim 2, wherein the supporting takes place when the free surface is displaced in the direction of the mandrel.

4. A method for extrusion of a metal pipe comprising the following steps:

(a) providing a mandrel having a first end and two pressing surfaces disposed at the first end, the two pressing surfaces being axially offset and having different radial characteristics, wherein the mandrel has a transition region between the two pressing surfaces and a supporting surface in the transition region;

(b) pressing a metal block to form the metal pipe, through a die and by way of the mandrel;

(c) repositioning the die axially with reference to a block mount such that the mandrel is repositioned from a first pressing position to a second pressing position, in the first pressing position, a first one of the two pressing surfaces of the mandrel acts on the metal block, and in the second pressing position, a second of the two pressing surfaces of the mandrel acts on the metal block; and (d) supporting the metal block on a mandrel side of the metal block, at an axial height of the die, while the mandrel is repositioned from the first pressing position to the second position.

5. The metal pipe extrusion method according to claim 4, wherein the supporting takes place first after a free surface with regard to the mandrel has been formed on the metal block.

6. The metal pipe extrusion method according to claim 5, wherein the supporting takes place first when the free surface is displaced in the direction of the mandrel.

* * * * *